US007934299B2

(12) United States Patent
Holzman

(10) Patent No.: US 7,934,299 B2
(45) Date of Patent: May 3, 2011

(54) CASKET INCORPORATING IMAGE DISPLAY DEVICE

(75) Inventor: Paul Holzman, Mason, OH (US)

(73) Assignee: Batesville Services, Inc., Batesville, IN (US)

( * ) Notice: Subject to any disclaimer, the term of this patent is extended or adjusted under 35 U.S.C. 154(b) by 226 days.

(21) Appl. No.: 12/240,527

(22) Filed: Sep. 29, 2008

(65) Prior Publication Data

US 2010/0077580 A1 Apr. 1, 2010

(51) Int. Cl.
*A61G 17/00* (2006.01)

(52) U.S. Cl. ..... 27/27; 27/2; 16/439; 40/725

(58) Field of Classification Search ..... 27/1, 2, 27/10, 27, 19; 345/104, 204; 369/69; 40/722, 40/725, 745; 52/103–104, 288.1; 403/353; 16/424, 439; 220/752, 756
See application file for complete search history.

(56) References Cited

U.S. PATENT DOCUMENTS

| | | | | |
|---|---|---|---|---|
| 5,404,343 | A | 4/1995 | Boggio | |
| 5,533,241 | A | 7/1996 | McConnell | |
| 5,729,921 | A | 3/1998 | Rojas | |
| 5,813,099 | A | 9/1998 | Stewart | |
| 5,887,321 | A | 3/1999 | Foley, Jr. | |
| 5,950,287 | A | 9/1999 | Cacciatore et al. | |
| 5,950,288 | A | 9/1999 | Bach Lahor | |
| 6,065,193 | A | 5/2000 | Foley, Jr. | |
| 6,223,404 | B1 | 5/2001 | Fant et al. | |
| 6,324,736 | B1 | 12/2001 | Atrio | |
| 6,340,978 | B1 | 1/2002 | Mindrum | |
| 6,414,663 | B1 | 7/2002 | Manross, Jr. | |
| 6,591,466 | B1 | 7/2003 | Acton et al. | |
| 6,665,916 | B1 | 12/2003 | Santorello et al. | |
| 6,735,831 | B1 | 5/2004 | Greiwe et al. | |
| 6,928,706 | B2 | 8/2005 | Acton et al. | |
| 6,975,308 | B1 * | 12/2005 | Bitetto et al. | 345/204 |
| 6,980,107 | B1 | 12/2005 | Ziegler | |
| 7,082,653 | B1 | 8/2006 | Sueppel | |
| 7,089,495 | B2 | 8/2006 | Barrows | |
| 7,191,499 | B2 | 3/2007 | Davis et al. | |
| 7,318,262 | B1 | 1/2008 | Florea | |
| 7,340,810 | B2 | 3/2008 | Acton et al. | |
| 7,373,703 | B1 | 5/2008 | Grenci | |
| 7,562,423 | B2 * | 7/2009 | Pryd-Kakuk | 27/1 |

(Continued)

FOREIGN PATENT DOCUMENTS

EP 2050427 A1 * 4/2009

OTHER PUBLICATIONS

Two drawing sheets of a casket corner ornament attachment clip in public use or on sale in the United States Greater than one year prior to Sep. 29, 2008.

(Continued)

*Primary Examiner* — William L. Miller
(74) *Attorney, Agent, or Firm* — Wood, Herron & Evans LLP

(57) ABSTRACT

A casket comprises a casket shell having a pair of side walls and a pair of end walls, a casket lid closable on the casket shell, and a digital image display device mounted to an exterior of at least one of the shell and the lid for displaying digital images.

9 Claims, 6 Drawing Sheets

U.S. PATENT DOCUMENTS

| | | | | |
|---|---|---|---|---|
| 7,698,792 | B1 | 4/2010 | Parker | |
| 2001/0036354 | A1 | 11/2001 | Majors | |
| 2006/0075343 | A1* | 4/2006 | Henry | 715/704 |
| 2009/0030804 | A1* | 1/2009 | Sell | 705/26 |
| 2010/0077577 | A1 | 4/2010 | Rojdev | |
| 2010/0077578 | A1 | 4/2010 | Motz et al. | |
| 2010/0077579 | A1 | 4/2010 | Parker | |
| 2010/0102685 | A1* | 4/2010 | Ward | 312/7.2 |
| 2010/0146750 | A1* | 6/2010 | Dannenberg | 27/1 |

OTHER PUBLICATIONS

Notice of Allowance, U.S. Appl. No. 12/240,598, 12 pages, Aug. 2, 2010.

Notice of Allowance, U.S. Appl. No. 12/240,647, 14 pages, Aug. 3, 2010.

* cited by examiner

CASKET INCORPORATING IMAGE DISPLAY DEVICE

RELATED APPLICATIONS

None.

FIELD

This invention relates generally to caskets, and more particularly to decorative ornaments attached to caskets.

BACKGROUND

There is a trend in the death care industry towards personalizing the funeral products and the funeral or other memorial service to the deceased to provide a more meaningful memorial experience for the family and friends of the deceased. The casket in which the deceased is displayed can be customized to fit the needs and preferences of the deceased and the family. For instance, a wide variety of materials, finishes, colors, and decorative ornamentation can be chosen for the casket.

Some casket designs incorporate decorative corner ornaments secured to the casket during fabrication thereof. In many, if not most, prior designs, these ornamental corner pieces are rigidly affixed to the casket shell. Consequently, if a customer purchasing the casket is not pleased with the particular pre-installed ornamental corner pieces, and wishes to customize the casket exterior to his or her taste, the funeral director must go through a lengthy and complicated process to first remove the original ornamental corner pieces and then reinstall the ornamental corner pieces chosen by the customer. This process typically requires manual manipulation and access to the interior of the casket which may require the removal of bedding, lining, and the like. Such a process is time consuming and can damage the otherwise new casket and is thus frowned upon and generally avoided by the funeral director.

To more effectively market caskets, the funeral director desires to offer a wide variety of ornamental corner pieces from which a customer can select according to the customer's taste. However, to offer such a wide selection, and to avoid the undesirable practice mentioned above, the funeral director would have to maintain a large inventory of many different casket material/finish and corner piece combinations, which is also undesirable. To minimize the required inventory of finished caskets, the funeral director could simply have one casket of each material/finish on hand provided that the funeral director had some means providing for the quick and efficient changing of the ornamental corner pieces on each casket. As such, the customer could quickly view numerous corner pieces on a single casket, and the funeral director would need only stock a single casket of each material finish. Many prior casket designs, which rigidly affix the ornamental corner pieces, do not permit such quick and efficient changing of the ornamental corner pieces as discussed above.

A quick-change casket corner mechanism is disclosed in Acton et al. U.S. Pat. Nos. 6,591,466, 5,928,706, and 7,340,810, assigned to the assignee of the present invention and incorporated by reference herein. The Acton et al. patents disclose an ornamental corner piece assembly having a back plate that attaches to the corner of a casket. The back plate includes a clip member having at least one keyhole groove. A decorative corner insert includes at least one attachment member that slidingly engages the keyhole groove in the clip member such that the corner insert removably couples to the back plate. In this way, a funeral director may quickly and conveniently change out the decorative corner pieces to provide a wide variety of casket designs personalized to the deceased. Such a quick change casket corner ornament is commercially available from the assignee as its LIFESYMBOLS® line of corner ornaments.

Advances have therefore been made in the area of casket designs incorporating decorative or ornamental corner pieces as demonstrated with the product discussed above. However, there continues to be room for improvement in the area of personalization in the death care industry.

SUMMARY

A casket comprises a casket shell having a pair of side walls and a pair of end walls, a casket lid closable on the casket shell, and a digital image display device mounted to an exterior of at least one of the shell and the lid for displaying digital images.

The digital image display device can be mounted to the shell. The casket can further comprise apparatus for removably securing the digital image display device to a mounting surface of the shell. That apparatus can comprise a first attachment element associated with the mounting surface, and a second attachment element associated with the digital image display device, the first and second attachment elements for removably securing the digital image display device to the shell. One of the first and second attachment elements can be at least one groove and the other of the first and second attachment elements can be at least one fastener having a head thereon. The at least one groove can comprise a slot and an opening communicating with the slot, the opening being of a greater dimension than the slot. The fastener can be a threaded fastener, for example a screw, for example a shoulder screw.

The shell can have a mounting member disposed between adjacent ones of the side and end walls, and the digital image display device can be mounted to the mounting member. The mounting member can be oriented at about a 45° angle relative to the adjacent ones of the side and end walls. The first attachment element can be associated with the mounting member, and the second attachment element can be associated with the digital image display device.

The first and second attachment elements can be configured such that the digital image display device is removably secured to the shell via motion in first and second non -parallel directions generally parallel to a plane defined by the mounting member. The groove can include a first keyhole portion and a second non-keyhole portion. The first keyhole portion can have a first longitudinal axis, the second non-keyhole portion can have a second longitudinal axis, and the first and second longitudinal axes can be non-parallel. For example, the first and second longitudinal axes can be perpendicular. For example, the first and second directions can be rectilinear.

The digital image display device can comprise a LCD screen. The digital image display device can further comprise a decorative frame surrounding the LCD screen. The digital image display device can comprise a memory for electronic photo image files. The memory can be configured to display the electronic photo image files as a slideshow. The digital image display device can comprise a power source. The digital image display device can comprise a USB port.

In another aspect a casket comprises a casket shell having a pair of side walls and a pair of end walls and a corner member between ends of adjacent ones of the side walls and the end walls, the corner member oriented at about a 45° angle relative to the adjacent ones of the side walls and the end walls, a casket lid closable on the casket shell, and a digital picture frame mounted to the corner member that displays digital still photographs.

The casket can further comprise an attachment clip for removably attaching the digital picture frame to the corner member, the attachment clip comprising a front portion having a pair of vertically spaced right angle keyhole grooves therethrough, having a rearwardly projecting circular post, and having a rectangular rib adjacent the post, and a back portion having a pair of vertically spaced spring tabs each of which cooperates with one of the pair of vertically spaced right angle keyhole grooves, having a circular hole for receiving the circular post, and having a rectangular hole for receiving the rectangular rib. The digital picture frame can include a pair of vertically spaced fasteners on a rear side thereof, each of which includes a head thereon. Each spring tab can include a pair of ribs spaced apart to accept the head of a respective one of the pair of fasteners.

In another aspect, a funerary article for containing human remains comprises a receptacle for receiving the human remains, a cover that closes the receptacle, and a digital picture frame attached to one of the receptacle and the cover that displays digital photographs.

The receptacle can be a casket shell and the cover can be a casket lid. The receptacle can be a cremation urn and the cover can be a cremation urn lid. The receptacle can be a casket shell and the cover can be a casket lid; the casket shell can have handles, arms connecting the handles to the shell and decorative lugs covering attachment points of the arms to the shell, and the digital picture frame can be mounted to one of the lugs.

DRAWINGS

DESCRIPTION

Figure 1:
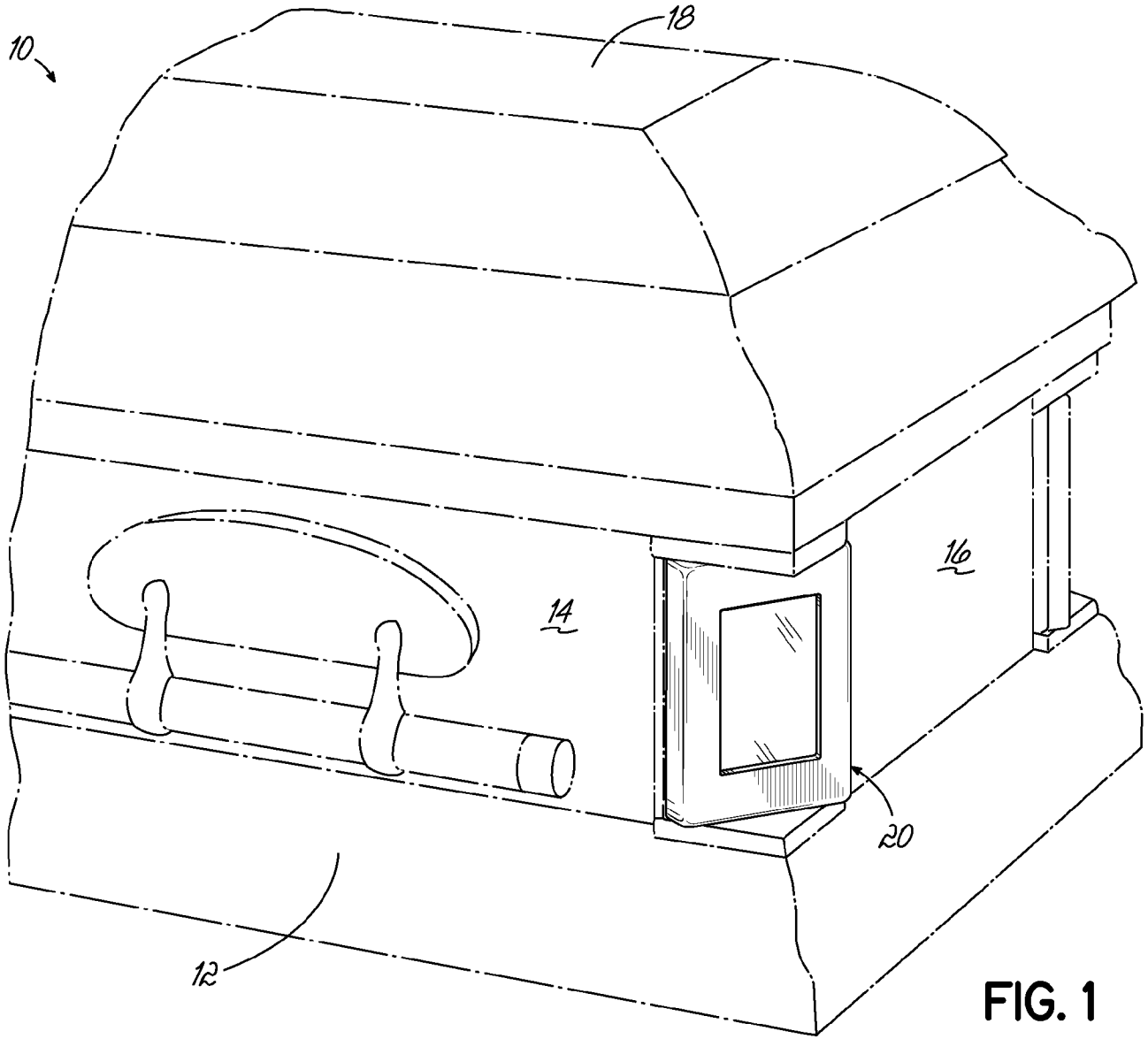
FIG. 1 is a partial perspective view of a casket with image display device.
Figure 2:
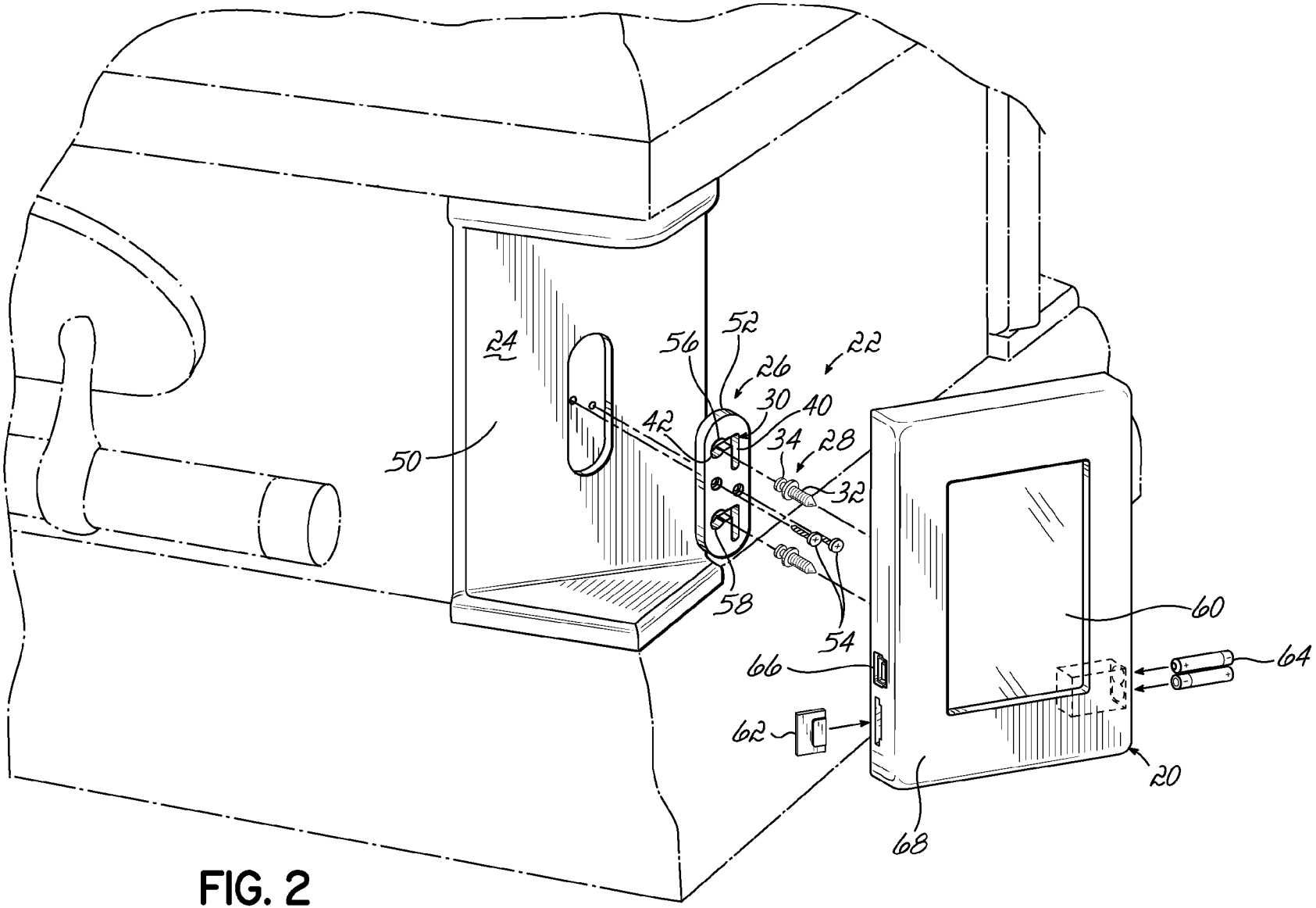
FIG. 2 is an exploded perspective view of the casket and image display device of FIG. 1.
Figure 3:
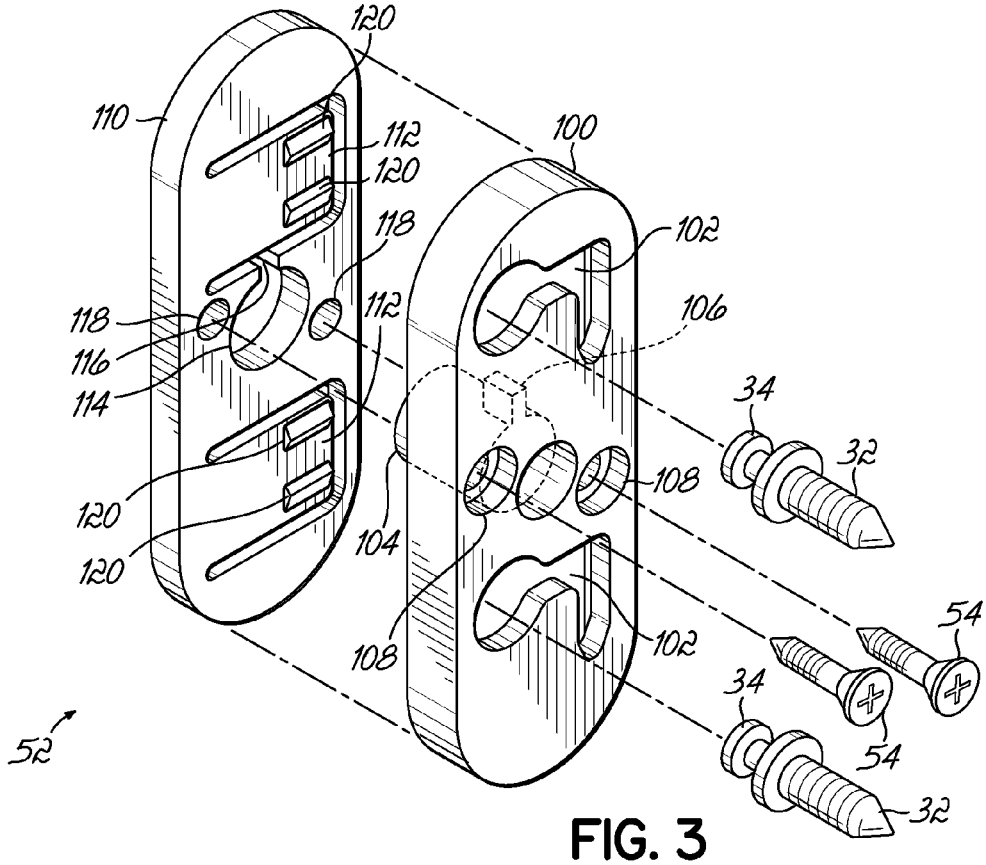
FIG. 3 is an exploded perspective view of an attachment clip for attaching the image display device to the casket.
Figure 4:
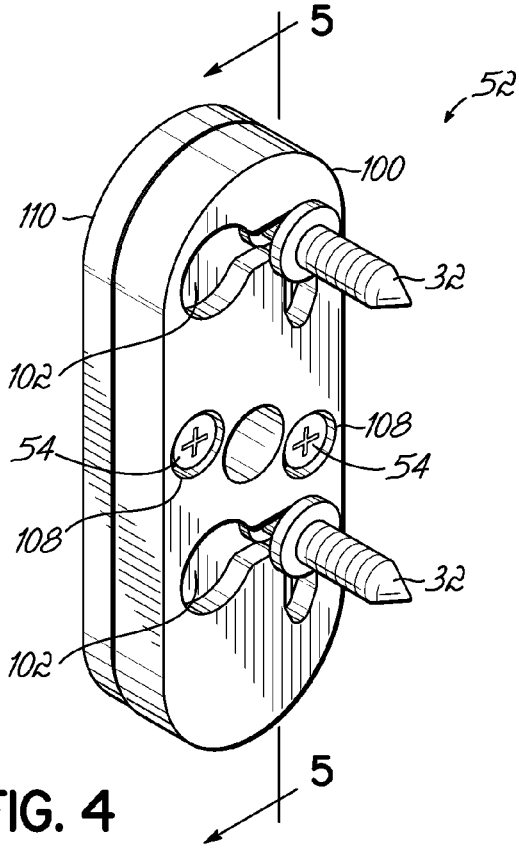
FIG. 4 is an assembled perspective view of the attachment clip of FIG. 3.

Referring to the figures, a casket 10 comprises a casket shell 12 having a pair of side walls 14 and a pair of end walls 16, a casket lid 18 closable on the casket shell 12, and a digital image display device 20 mounted to an exterior of either the shell 12 or the lid 18 for displaying digital images.

For example, the digital image display device 20 can be mounted to the shell 12 as illustrated. The casket 10 can further comprise apparatus 22 for removably securing the digital display device 20 to a mounting surface 24 of either the shell 12 or the lid 18. That apparatus 22 can comprise a first attachment element 26 associated with the mounting surface 24, and a second attachment element 28 associated with the digital image display device 20, the first 26 and second 28 attachment elements for removably securing the digital display device 20 to the shell 12. One of the first 26 and second 28 attachment elements can be at least one groove 30 and the other of the first 26 and second 28 attachment elements can be at least one fastener 32 having a head 34 thereon. The at least one groove 30 can comprise a slot 40 and an opening 42 communicating with the slot 40, the opening 42 being of a greater dimension than the slot 40. The fastener 32 can be a threaded fastener, for example a screw. The screw can be for example a shoulder screw.

The shell 12 can have a mounting member 50 disposed between adjacent ones of the side 14 and end 16 walls, and the digital image display device 20 can be mounted to the mounting member 50. Accordingly in this example the mounting surface 24 is a part of the mounting member 50 of the shell 12. Mounting member 50 can be the back plate shown and described in the Acton et al. patents. Other mounting surfaces 24 and mounting members 50 on either the shell 12 or lid 14 are possible. The mounting member 50 can be oriented at a 45° angle relative to the adjacent ones of the side 14 and end 16 walls. The first attachment element 26 can be associated with the mounting member 50, and the second attachment element 28 can be associated with the digital image display device 20. For example, groove 30, or a pair of grooves 30, can be formed in an attachment clip 52 secured to mounting member 50 with screws 54, and the shoulder screws 32 can be secured to the rear side of the digital image display device 20.

The first 26 and second 28 attachment elements can be configured such that the digital image display device 20 is removably secured to the shell 12 via motion in first and second non-parallel directions generally parallel to a plane defined by the mounting member 50. The groove(s) 30 can include a first keyhole portion 56 and a second non-keyhole portion 58. The first keyhole portion 56 can have a first longitudinal axis, the second non-keyhole portion 58 can have a second longitudinal axis, and the first and second longitudinal axes can be non-parallel. For example, the first and second longitudinal axes can be perpendicular. For examples, the first and second directions can be rectilinear or curvilinear.

To install the digital image display device 20, the head(s) 34 of the fastener(s) 32 are inserted into opening(s) 42 of groove(s) 30; digital image display device 20 is then moved generally parallel to a plane defined by mounting member 50 from left to right as illustrated thus sliding head(s) 34 from left to right in slot(s) 30. The digital image device 20 is then moved again generally parallel to the plane defined by the mounting member 50 downwardly thus sliding head(s) 34 down in slot(s) 40. While not required, the multi-direction movement to install ornament 20 can reduce the potential for the ornament 20 to become inadvertently dislodged from mounting member 50.

The digital image display device 20 can comprise a LCD screen 60. The digital image display device can comprise a memory 62 for electronic photo image files. The memory 62 can be configured to display the electronic photo image files as a slideshow. The digital image display device 20 can comprise a power source 64. The digital image display device 20 can comprise a USB port 66 for connection to a digital camera, laptop computer, personal computer, etc. in order to load the electronic photo image files into the memory 62. The digital image display device 20 can further comprise a decorative frame 68 surrounding the LCD screen 60. For example, one commercially available digital image display device 20 or so-called "digital picture frame" suitable for use with casket 10 is the Pandigital (5.6" Tru Photo) model number PAN56-1.

Figure 5A:
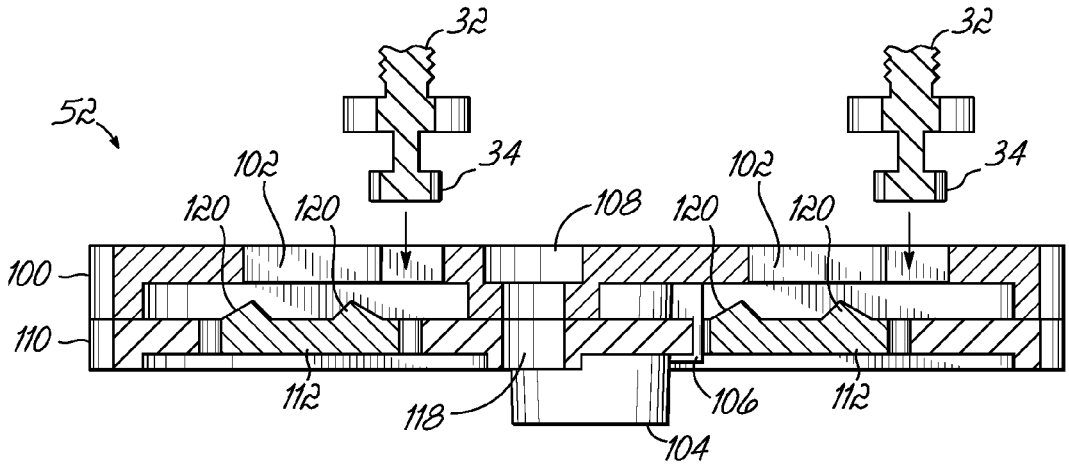
FIG. 5A is a view taken along line 5-5 in FIG. 4 showing the image display device and its fastener prior to attachment to the attachment clip.
Figure 5B:
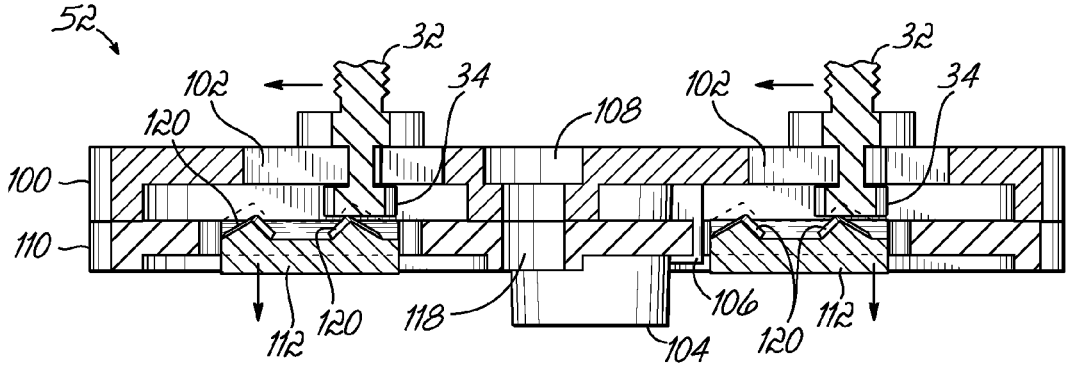
FIG. 5B is a view similar to FIG. 5A showing the image display device fastener head inserted into the attachment clip.
Figure 5C:
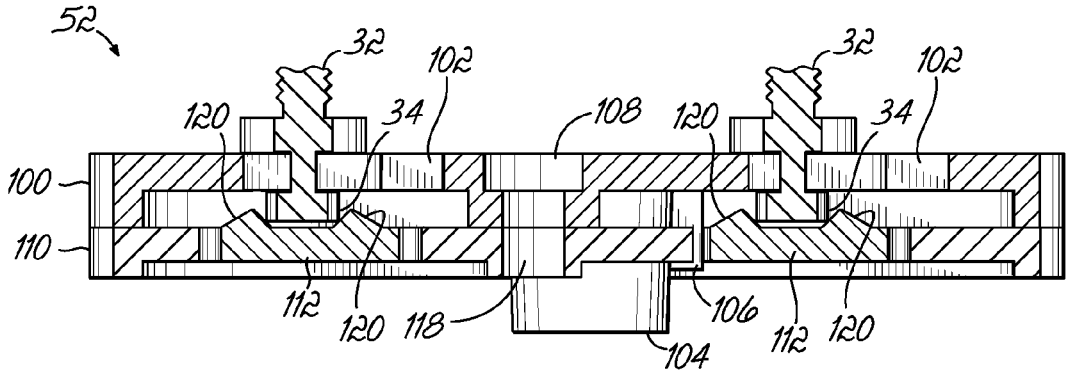
FIG. 5C is a view similar to FIG. 5B showing the image display device fastener head slid into its final position in the attachment clip and coming to rest between the two ribs on the spring tab.

Referring to FIGS. 3-5C, one form of attachment clip 52 which could be used is illustrated. The attachment clip 52 can have a front portion 100 having a pair of vertically spaced right angle keyhole grooves 102 therethrough, a rearwardly projecting circular post 104, and a rectangular rib 106 adjacent the post 104. The attachment clip 52 can have a back portion 110 having a pair of vertically spaced spring tabs 112 each of which cooperates with one of the pair of vertically spaced right angle keyhole grooves 102, a circular hole 114 for receiving the circular post 104, and a rectangular hole 116 for receiving the rectangular rib 106. Post 104, rib 106, hole 114, and hole 116 are to properly orient the front portion 100 with the back portion 110. Both portions have holes 108, 118, respectively, for receiving screws 54, rivets, etc. Each spring tab 112 can include a pair of ribs 120 which are spaced apart to accept the head 34 of fastener 32. As seen in FIGS. 5A-5C, heads 34 are inserted into keyhole grooves 102, slid to the right, and then slid down. Sliding the heads 34 down causes the spring tabs 112 to deflect rearwardly as heads 34 travel down and over the uppermost ones of the pairs of ribs 112. Once over the uppermost ones of the pairs of ribs 112, spring tabs spring forwardly retaining heads 34 between ribs 112 and against a rear surface of keyhole grooves 102.

Figure 6:
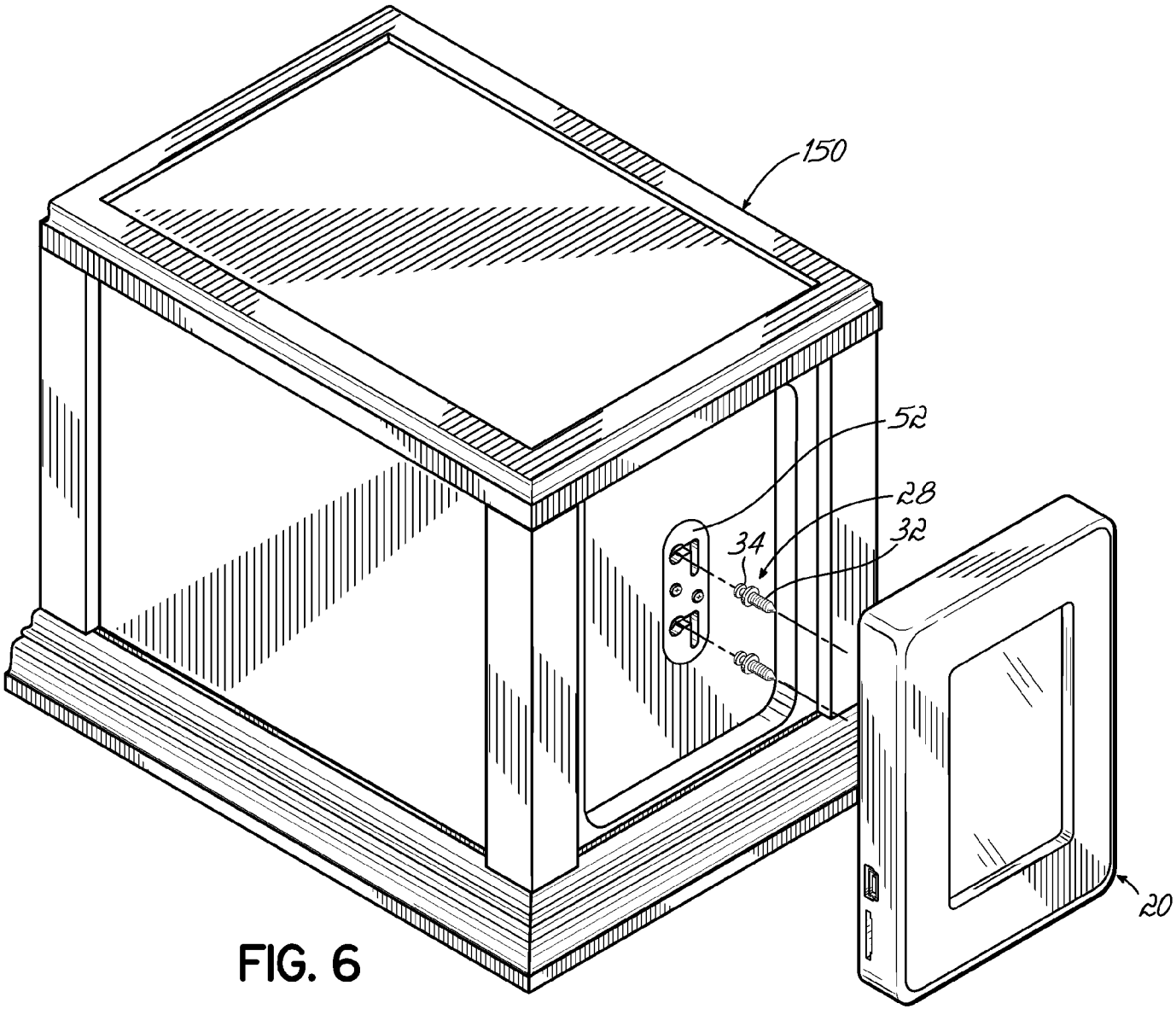
FIG. 6 is a perspective of the inventive concept as applied to a cremation urn.
Figure 7:
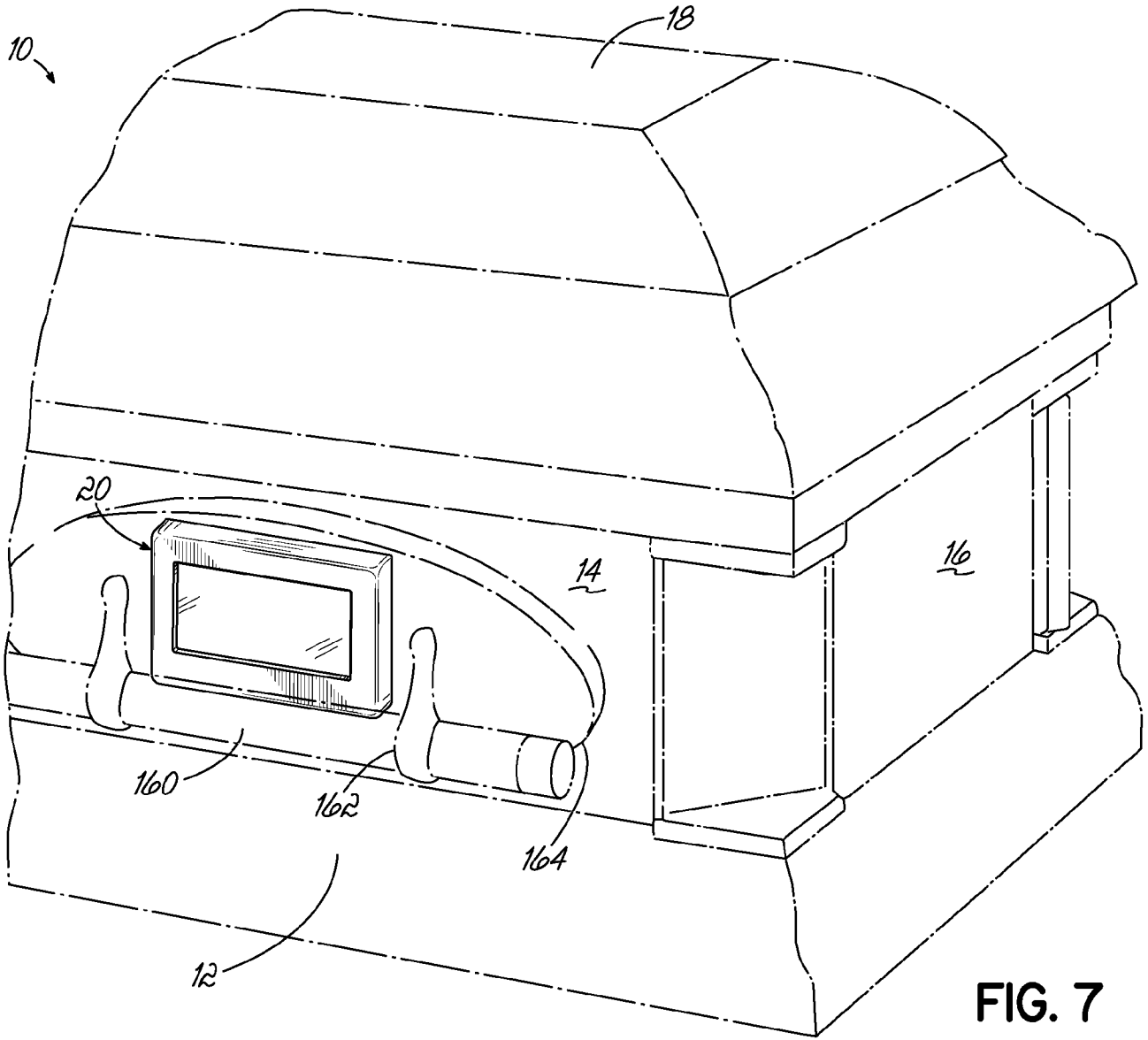
FIG. 7 is a view similar to FIG. 1 of the inventive concept as applied to the ear or lug of the casket shell.

The embodiments shown and described are merely for illustrative purposes only. The drawings and the description are not intended to limit in any way the scope of the claims. Those skilled in the art will appreciate various changes, modifications, and other embodiments. All such changes, modifications and embodiments are deemed to be embraced by the claims. For example, while the funerary article for containing human remains has been shown in the drawings to be a casket, it could just as well be a cremation urn. See FIG. 6, wherein digital picture frame 20 is mounted to a cremation urn 150. As a further example, with reference to FIG. 7, caskets typically have handles 160 attached to the shell 12 with arms 162 and decorative ears or lugs or escutcheon plates 164 covering the attachment points of the arms 162 to shell 12; a digital picture frame 20 could be mounted to one or more of the ears/lugs/escutcheon plates 164. Also, if desired, either an upper edge or a lower edge of the digital image display device could be tilted outwardly to facilitate viewing of the images. Accordingly, the scope of the right to exclude shall be limited only by the following claims and their equivalents.

What is claimed is:

1. A funerary article for containing human remains comprising:

a receptacle for receiving the human remains, a cover that closes said receptacle, and a digital picture frame attached to one of said receptacle and said cover that displays digital photographs, wherein said receptacle is a casket shell and said cover is a casket lid, wherein said casket shell has handles, arms connecting said handles to said shell, and decorative lugs covering attachment points of said arms to said shell, and said digital picture frame is mounted to one of said lugs.

2. A casket comprising:

a casket shell having a handle, an arm connecting said handle to said shell, and a lug covering an attachment point of said arm to said shell, a casket lid closable on said casket shell, and a digital image display device mounted to said lug.

3. The casket of claim 2 wherein said digital image display device comprises a LCD screen.

4. The casket of claim 3 wherein said digital image display device further comprises a decorative frame surrounding said LCD screen.

5. The casket of claim 2 wherein said digital image display device comprises a memory for electronic photo image files.

6. The casket of claim 5 wherein said memory is configured to display the electronic photo image files as a slideshow.

7. The casket of claim 2 wherein said digital image display device comprises a power source.

8. The casket of claim 2 wherein said digital image display device comprises a USB port.

9. The casket of claim 2 wherein said digital image display device is a digital picture frame that displays digital still photographs.

* * * * *